US010724175B2

(12) United States Patent
Gscheider et al.

(10) Patent No.: US 10,724,175 B2
(45) Date of Patent: Jul. 28, 2020

(54) ROTOR BLADE AND SCREEN COMPRISING A ROTOR BLADE

(71) Applicant: Andritz AG, Graz (AT)

(72) Inventors: Alexander Gscheider, Hohentauern (AT); Erwin Hertl, Judendorf (AT)

(73) Assignee: ANDRITZ AG, Graz (AT)

( * ) Notice: Subject to any disclaimer, the term of this patent is extended or adjusted under 35 U.S.C. 154(b) by 100 days.

(21) Appl. No.: 16/073,350

(22) PCT Filed: Nov. 15, 2016

(86) PCT No.: PCT/EP2016/077749
§ 371 (c)(1),
(2) Date: Jul. 27, 2018

(87) PCT Pub. No.: WO2017/133803
PCT Pub. Date: Aug. 10, 2017

(65) Prior Publication Data

US 2019/0040578 A1 Feb. 7, 2019

(30) Foreign Application Priority Data

Feb. 3, 2016 (AT) ..... A 50063/2016

(51) Int. Cl.
*D21D 5/02* (2006.01)

(52) U.S. Cl.
CPC ..... *D21D 5/026* (2013.01)

(58) Field of Classification Search
USPC ..... 162/274, 273
See application file for complete search history.

(56) References Cited

U.S. PATENT DOCUMENTS

| | | | |
|---|---|---|---|
| 3,939,065 | A | 2/1976 | Einarsson Ahlfors |
| 5,497,886 | A | 3/1996 | Young et al. |
| 6,588,599 | B2 | 7/2003 | Gabl et al. |
| 8,950,584 | B2 | 2/2015 | Harju et al. |

FOREIGN PATENT DOCUMENTS

| | | | |
|---|---|---|---|
| CN | 104532652 | A | 4/2015 |
| DE | 102009014810 | A1 | 9/2010 |
| EP | 1632601 | A2 | 3/2006 |
| EP | 1837437 | A1 | 9/2007 |
| WO | 9401618 | A1 | 1/1994 |
| WO | 2012084562 | A1 | 6/2012 |

OTHER PUBLICATIONS

International Search Report dated Jan. 20, 2017 (PCT/EP2016/077749).
International Preliminary Report on Patentability dated May 7, 2018 (PCT/EP2016/077749).

*Primary Examiner* — Mark Halpern
(74) *Attorney, Agent, or Firm* — Alix, Yale & Ristas, LLP

(57) ABSTRACT

The invention relates to a blade for screens for the treatment of a fibrous suspension, said blade being mountable on a rotor of the screen. According to the invention, the blade has a curved leading edge or curved envelope of the leading edge, the curvature extending in the direction of the trailing edge, and a curved trailing edge or curved envelope of the trailing edge, said curvature extending in the same direction as the other one. The invention also relates to a screen comprising a rotor on which the disclosed blades are mounted.

20 Claims, 5 Drawing Sheets

A-A ( 1 : 1 )

A-A ( 1 : 1 )

ROTOR BLADE AND SCREEN COMPRISING A ROTOR BLADE

BACKGROUND

This application is a 371 of PCT/EP2016/077749 filed 15 Nov. 2016.

The disclosure relates to a blade for screens that are normally used to treat fibrous pulp suspensions. The blade can be secured to the rotor and has a leading edge and a trailing edge. A screen with blades is also disclosed.

A state-of-the-art screen for cleaning a fibrous pulp suspension is shown in FIG. 1. It has a rotor 1 and a screen basket 8. The rotor 1 rotates round the rotor axis 2. The sense of rotation of the rotor 1 is indicated by an arrow. Several blades 3 are bolted to the brackets 4 through fastening holes 7 at the rotor 1. Of course, it is also conceivable to secure the blades by welding. The spacing between the blades and the screen basket 8 is shown here as Y.

When viewed in a horizontal projection, the blades 3 have a straight leading edge 5 and a straight trailing edge 6. Their cross-section has a wing-shaped profile, but other shapes are also possible here and are also in use.

During operation, pressure and suction pulses as well as turbulence are generated by the blades 3 at the screen basket 8 perforation (holes or slots). This prevents the screen basket openings from being blocked. Due to generation of these pulses and turbulences, a screen consumes a lot of energy and is thus expensive to operate. Rotor blades with a curved leading edge are also known from EP2203590A1, WO2012084562A1, DE102009014810A1, EP1143065A2, U.S. Pat. No. 3,939,065A, DE69424661T2, WO9401618A1, CN104532652A and DE6012137T2. U.S. Pat. No. 3,939,065 A discloses a rotor body with elevations that have a curved leading edge and a slightly curved trailing edge. EP 1 143 065 A2 discloses a blade with straight leading and trailing edges that are slanted towards the rear.

SUMMARY

It would be useful to have improved blades and screens such that they require less energy for at least the same cleaning performance.

The disclosed blades have a curved leading edge in the blade's horizontal projection or an arched envelope curve at the leading edge. The leading edge is curved towards the trailing edge. On the other hand, the trailing edge or the envelope curve of the trailing edge is curved in the same direction as the leading edge. The blade which is spaced apart from the rotor has a cross-section with a wing-shaped profile according to the invention, where the convex upper side of the blade is facing the screen basket.

Such blades have been shown to require less energy for the same or even better cleaning performance than conventional blades.

Due to the curved leading edge, the pressure pulse generated by the blade on the screen basket is also distributed better. As a result, the forces acting locally on the screen basket are reduced and the service life of the basket is increased. In addition, there is a very flat pulsation pattern on the screen accepts side, which means that this blade can be used for paper machine headbox screens where very low fluctuations in pressure are required.

Here, the leading edge can be curved symmetrically, for example in an arc shape, from the middle of the blade to its ends.

In one embodiment, the leading edge is stepped so that the envelope curve is arched towards the trailing edge. In this case, the trailing edge is preferably also stepped.

This type of blade shape can be created, for example, when a conventional blade with straight leading and trailing edges is cut into individual slices, with the cut surfaces at right angles to the leading edge. The slices are then reassembled beginning at the centre of the blade and working towards the ends in a staggered pattern towards the rear in the direction of the trailing edge. This creates a blade with a stepped leading and trailing edge and with envelope curves arching towards the rear. If the original blade has a wing-shaped profile, the upper and lower sides of the blade will be stepped in places (see FIGS. 8 and 9), which again improves the flow pattern.

It is favourable if bars are provided on the upper side of the blade that run from the leading edge to the trailing edge. Here, these bars do not begin directly at the leading edge, but may also be a little shorter. These bars can be provided both at the side facing the screen basket and the side facing the rotor.

In another embodiment, the leading edge or its envelope curve and the trailing edge or its envelope curve are arched equally, and the wing profile is largely the same over the entire length of the blade.

In the front area (the first area to be moved through the fibrous pulp suspension), the blade can be broader than in the rear section, i.e. the spacing between the two end points of the leading edge is then larger than the spacing between the two end points of the trailing edge.

Also disclosed herein is a screen for treating a fibrous pulp suspension containing a rotor with blades as described above.

The blades can be mounted parallel to the rotor axis or slanting. The load on the screen basket can be further reduced as a result of the slanting arrangement of the blade (see FIG. 6). The slanting position of the blades can differ in the various rows of blades so that they are at the optimum angle to the spiral flow of the suspension. This angle is preferably in the range of 0° to +/−25°.

The slanting position of the blades can be such that the top end of the blade leads the way for the bottom end of the blade or that the bottom blade end leads the way for the top blade end.

Similarly, both slanting positions can be used on one rotor. In this way, the dwell time of the pulp suspension at the rotor body and screen basket can be set and optimized. The dwell time depends on the type of pulp and on the consistency and flow pattern of the suspension.

It is an advantage if the spacing Y between the individual blades and the screen basket varies when viewed over the rotor height Z.

For example, the blades in the top inlet area of the screen can sweep past closer to the screen basket than the blades in the bottom area or vice versa (depends on the type of pulp and on the consistency and flow pattern of the suspension).

BRIEF DESCRIPTION OF THE PREFERRED EMBODIMENT

In the following, some embodiments of the invention are described on the basis of drawings. In these drawings.

DETAILED DESCRIPTION

Identical reference signs in the respective figures refer to the same type of components in each case.

Figure 1:
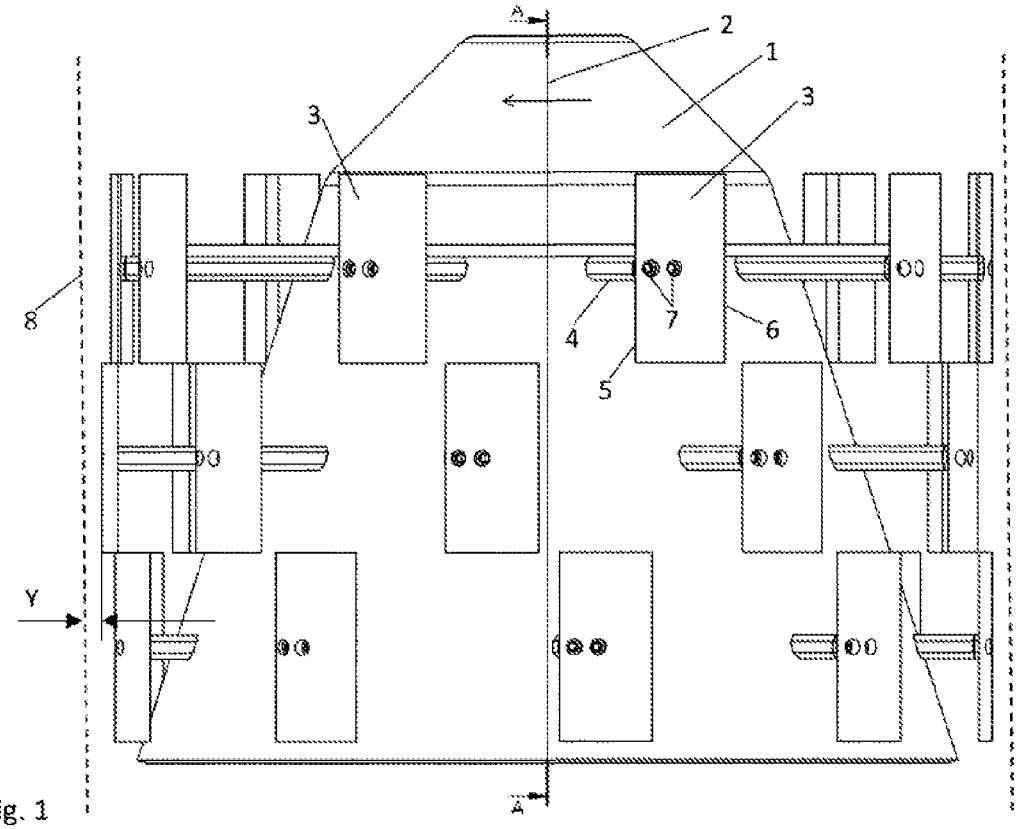
Fig. 1 (Prior Art)
FIG. 1 shows a conventional, prior art screen as already described above.
Figure 2:
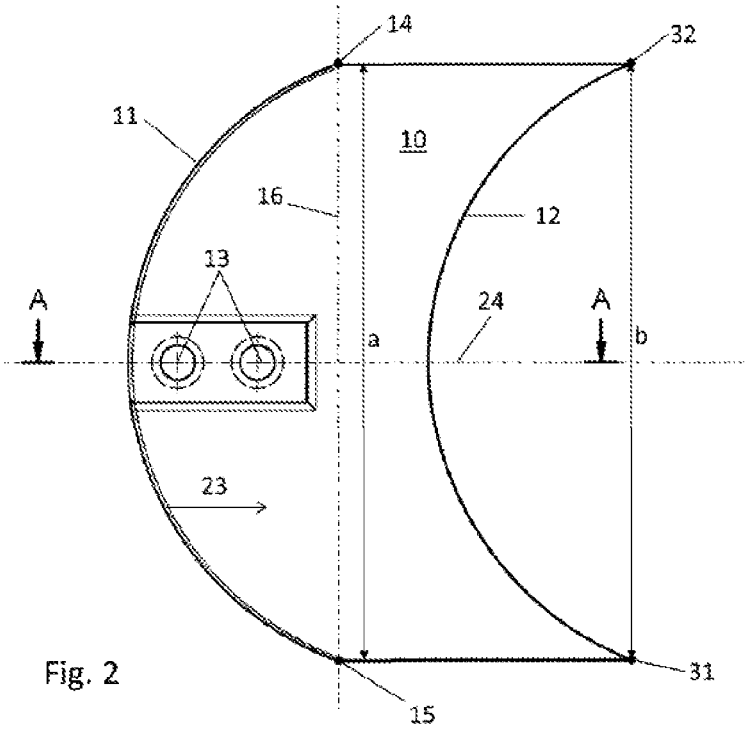
FIG. 2 shows a horizontal projection of a blade according to the disclosure.

FIG. 2 shows an example of an embodiment of the blade 10. It has a leading edge 11 which is curved towards the trailing edge 12 when viewed in the horizontal projection. This direction is marked with an arrow and the reference numeral 23. The leading edge 11 is curved symmetrically in relation to the blade centre line 24. The two fastening holes 13 for the fastening bolts also lie on the blade centre line 24. The leading edge 11 ends at the blade ends in endpoints 14 and 15 and the straight line between these two points has the reference numeral 16. The spacing between the two endpoints 14 and 15 is marked a.

The trailing edge 12 is also curved towards 23 to the same extent as the leading edge 11. The trailing edge 12 ends at the blade ends in endpoints 31 and 32 and the spacing between these two points 31 and 32 is marked b. Both spacings a and b are the same here, and the blade 19 has an even width.

Both edges 11, 12 are curved in an arc shape.

Figure 3:
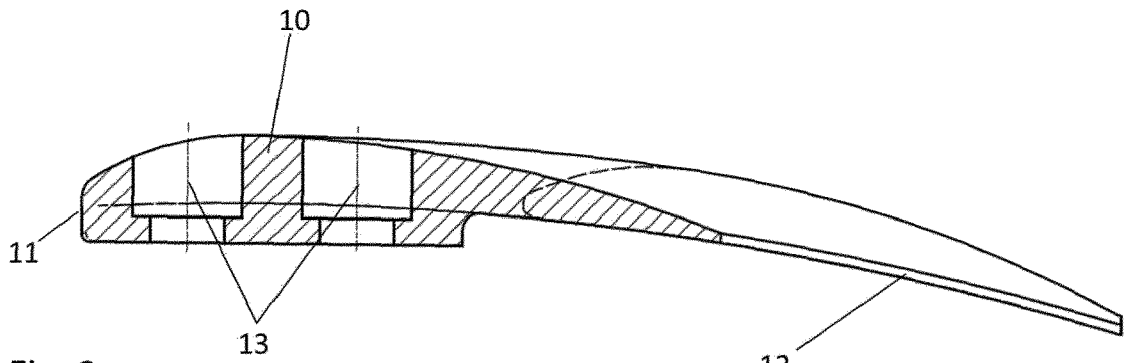
FIG. 3 shows a cross-section through the blade according to FIG. 2 with a possible design using fastening screws.

FIG. 3 shows a cross-section through the blade 10 according to FIG. 2. Here it is easy to see the wing-shaped profile with the convex upper side of the blade facing the screen basket.

Figure 4:
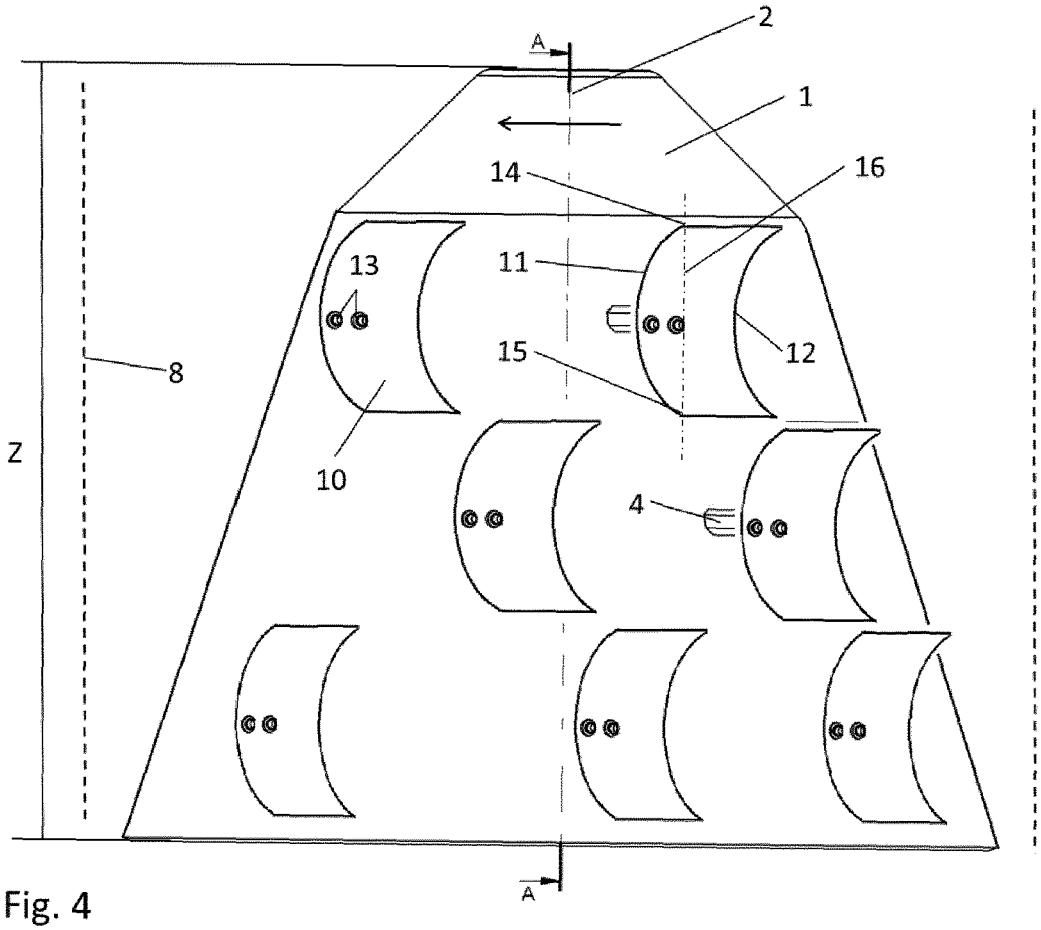
FIG. 4 shows a screen with blades according to the disclosure as shown in FIGS. 2 and 3.

FIG. 4 shows a screen with a screen basket 8 and a rotor 1 on which several blades 10 according to FIGS. 2 and 3 are mounted. In order to provide a better overview, the blades 10 in the peripheral areas are not shown here. The height of the rotor 1 is marked Z. The blades 10 are distributed over the rotor height Z here in three levels. Of course, more or fewer levels can also be used. In FIG. 4, the blades 10 are arranged on one level in each case around the perimeter in relation to the height Z such that the blades 10 on different levels sweep past different areas of the screen basket. The blades 10 cans also be placed in an offset arrangement over the height Z of the rotor 1 such that blades 10 on different levels sweep past the same areas of the screen basket.

All blades 10 are arranged in parallel to the rotor axis 2 in FIG. 4, i.e. the straight line 16 between the two endpoints 14 and 15 of the blade's trailing edge 11 is parallel to the rotor axis 2.

Figure 5:
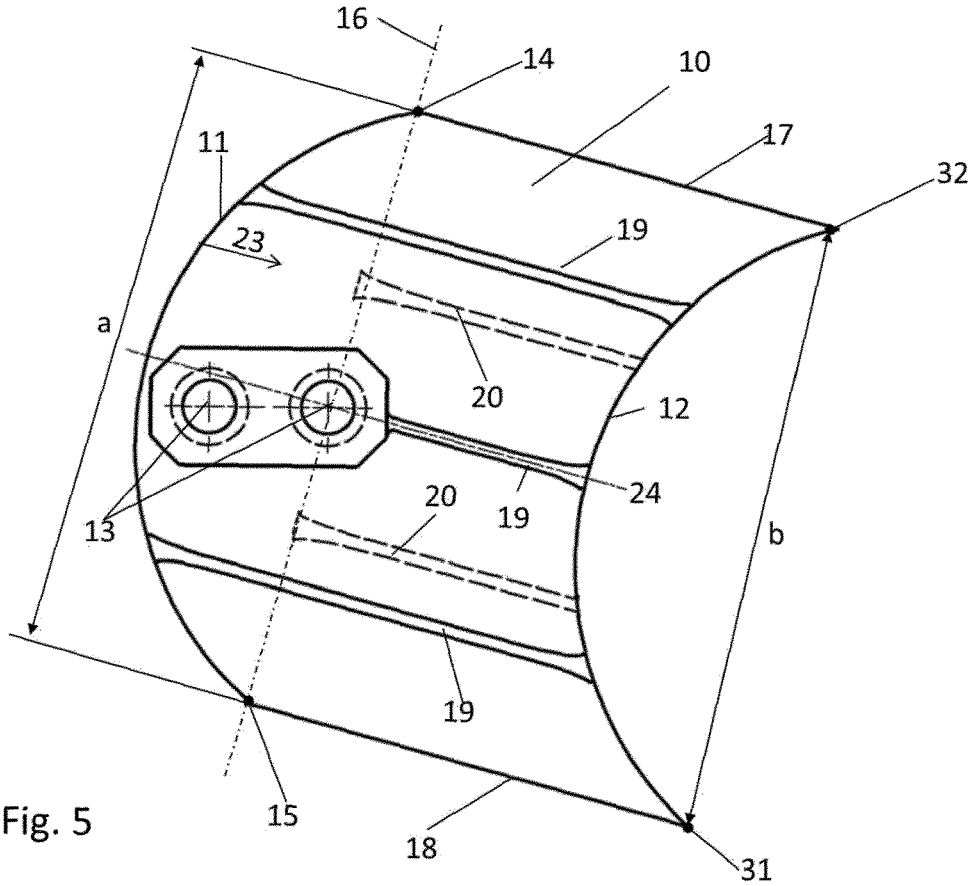
FIG. 5 shows a horizontal projection of another embodiment of a blade.
Figure 6:
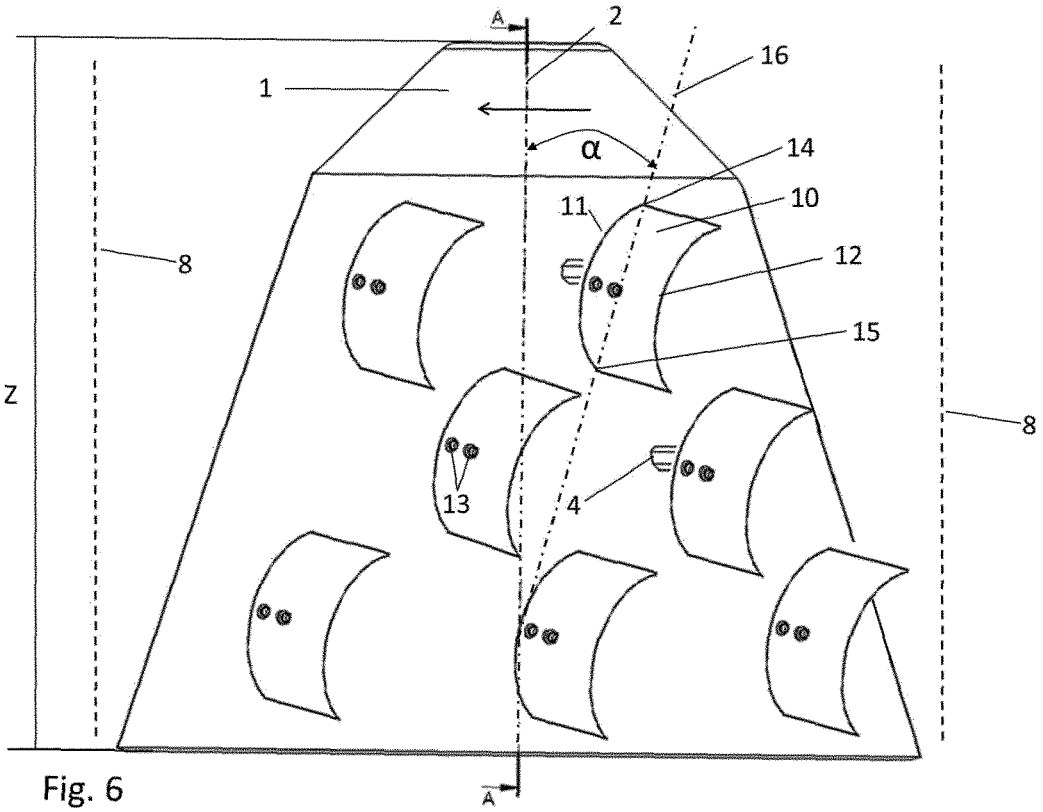
FIG. 6 shows a screen with blades according to FIG. 5.

FIG. 5 shows a blade 10 that is very similar to the blade 10 in FIG. 2, however the two fastening holes 13 here do not lie on the centre line 24 of the blade. This blade 10 is mounted on the rotor 1 on a slant, as shown in FIG. 6. The straight line 16 between the two endpoints 14 and 15 of the blade's leading edge 11 also is not parallel to the rotor axis 2, but forms an angle $\alpha$ of +/−20°, preferably +/−10°, with this axis when viewed in cross-section.

The blade 10 according to FIG. 5 has three bars 19 on the inner side (the side facing away from the screen basket) and two bars 20 on the outer side (the side facing the screen basket 8). These bars 19, 20 have a favourable effect on the flow pattern; of course, more or fewer bars 19 or 20 can also be used. The two blade ends 17 and 18 run here in parallel, i.e. the blade has the same width at all points.

Figure 7:
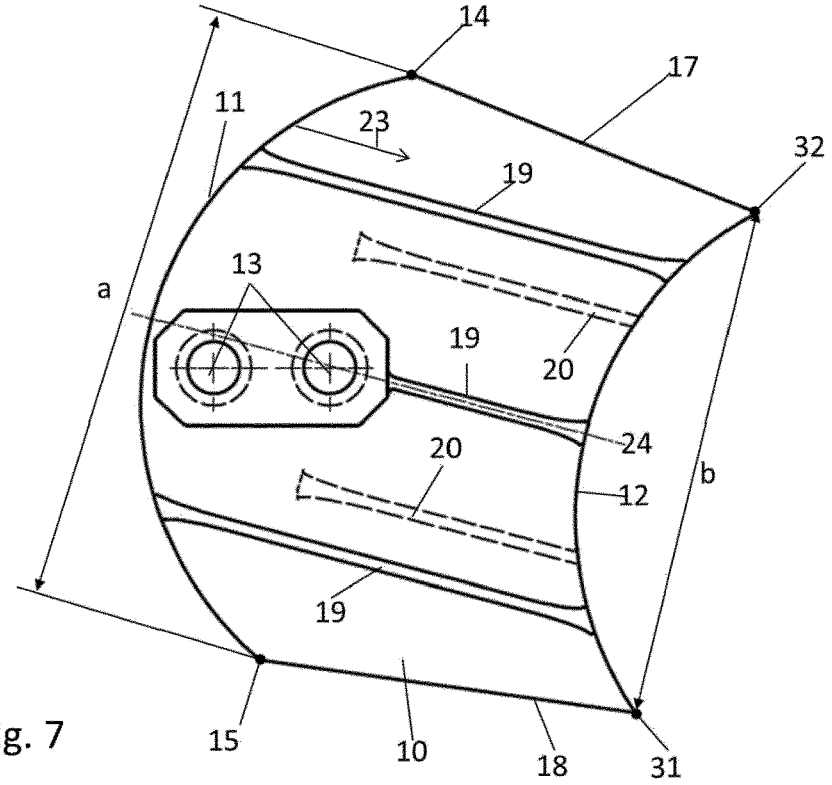
FIG. 7 shows a horizontal projection of another embodiment of a blade and which is narrower in the rear section.

FIG. 7 shows a blade 10 that is narrower in the rear section than at the leading edge 11, unlike the blade 10 in FIG. 5. Thus, the two blade ends 17, 18 do not run in parallel here and the spacing a between the two endpoints 14 and 15 of the leading edge 11 is larger than the spacing b between the two endpoints 31 and 32 of the rear edge 12.

Figure 8:
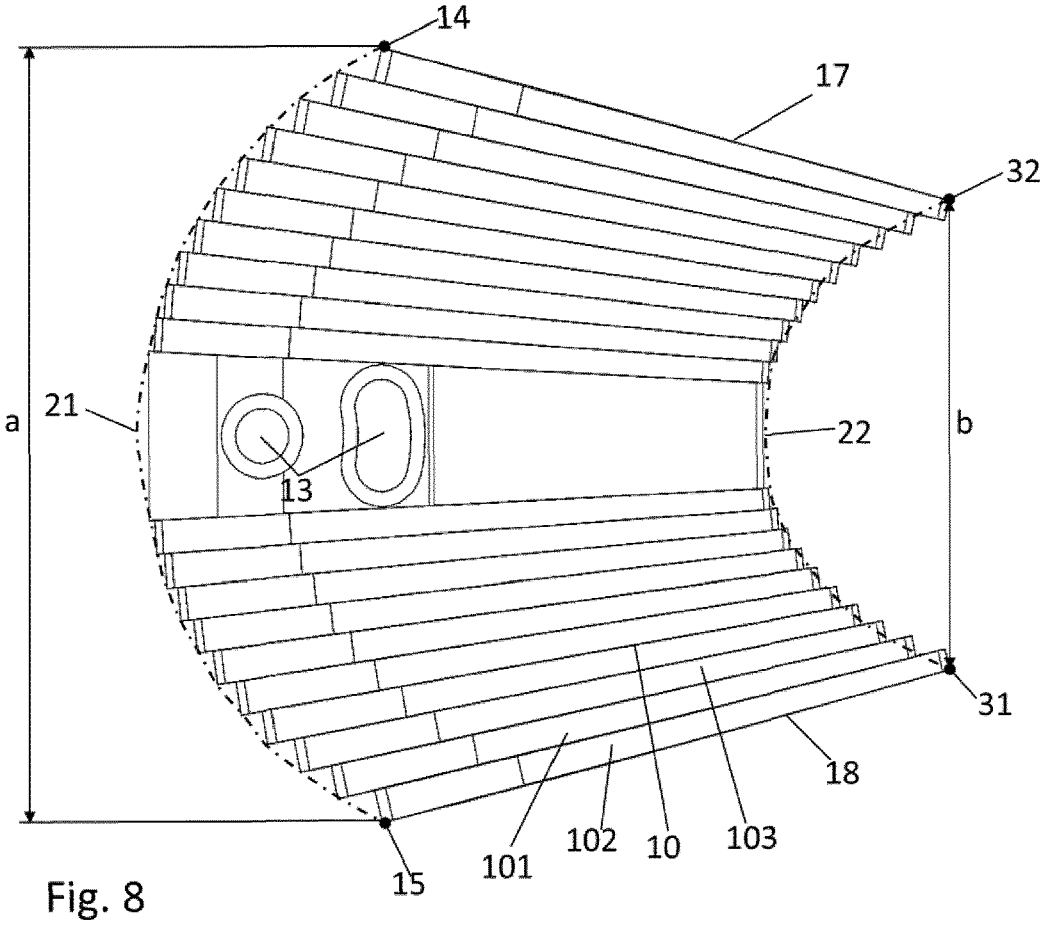
FIG. 8 shows a horizontal projection of a blade, where the leading edge and the trailing edge are stepped.

Another blade 10 according to the invention is shown in the horizontal projection in FIG. 8. The leading edge is stepped here, as is the trailing edge, such that the envelope curve 21 is arched towards the trailing edge. The envelope curve 22 of the trailing edge is arched in the same direction, but more than the envelope curve 21 of the leading edge in the present example.

Figure 9:
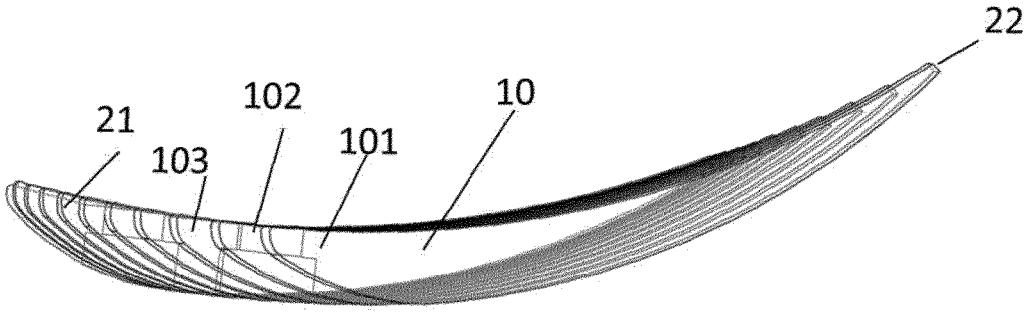
FIG. 9 shows a cross-section through the blade according to FIG. 8.

The cross-section of the blade 10 in FIG. 8 is shown in FIG. 9, showing the wing-shaped profile clearly. The individual blade segments 101, 102 and 103 all have a wing-shaped profile and are narrower in the rear section than at the leading edge. The blade segments 101, 102 and 103 are assembled in an offset arrangement to one another such as to form the stepped leading and trailing edges. In addition, bars are formed as a result on the upper and lower sides of the blade. This blade 10 is narrower at the rear than at the front due to the slightly V-shaped segments 101, 102 and 103. The spacing a between the two endpoints 14 and 15 of the leading edge is thus larger than the spacing b between the two endpoints 31 and 32 of the trailing edge of the blade. Of course, it is also conceivable that both spacing a and spacing b are identical and the side edges of the blades 17 and 18 are parallel.

The blade 10 according to FIG. 8 is not only suitable for straight mounting on the rotor 1, but can also be mounted on a slant through the slot-shaped fastening hole 13, i.e. so that the straight line 16 between the two endpoints 14 and 15 do not run parallel to the rotor axis 2. With this variant, the angle setting can be custom-tailored for the respective application. It is also conceivable that the blade's leading edge 11 is not stepped but wavy or that the top blade surface is also wavy.

Figure 10:
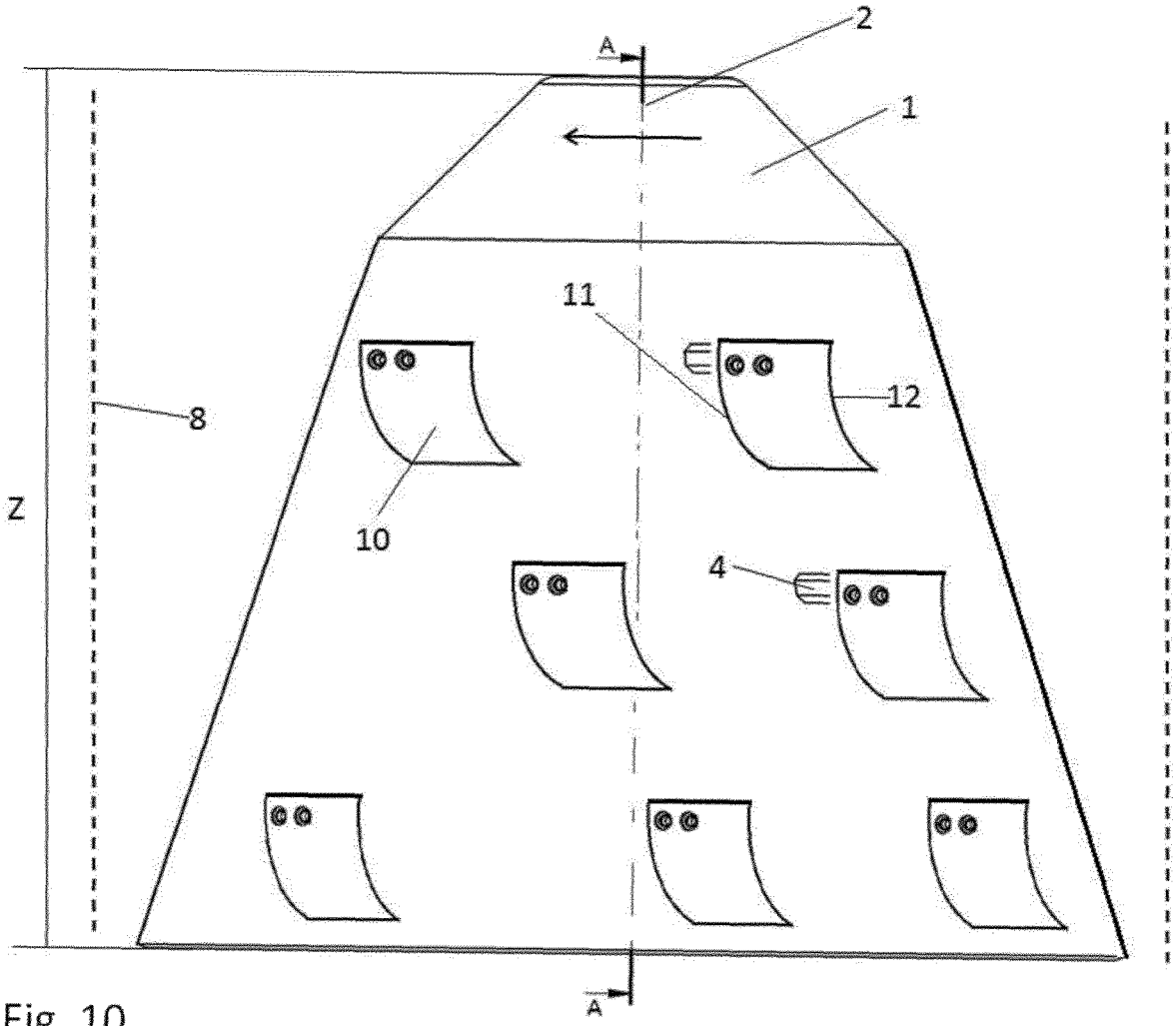
FIG. 10 shows another screen with blades according to the disclosure.

FIG. 10 shows an example of another embodiment of a screen with blades 10. Here the blades 10 are asymmetrical and secured to the rotor 1 at the top edge.

The invention claimed is:

1. A blade (10) for screens used to treat a fibrous pulp suspension which blade (10) is configured for attachment to a screen rotor (1) and where the blade (10) extends between a leading edge (11) and a trailing edge (12) with two opposite end edges (17, 18) therebetween and defines an upper side and lower side, the leading edge (11) or an envelope curve (21) thereof being arched in a direction (23) toward the trailing edge (12), the trailing edge (12) or the envelope curve (22) of the trailing edge (12) being arched in a common direction (23) relative to the leading edge (11), wherein the blade (10) has a cross-section with a wing-shaped profile having a convex upper surface.

2. The blade (10) according to claim 1, wherein the leading edge (11) is curved symmetrically from the middle of the blade (24) towards its opposite end edges (17, 18).

3. The blade (10) according to claim 2, wherein the leading edge (11) or the envelope curve (21) of the leading edge (11) is curved in an arc shape.

4. The blade (10) according to claim 1, wherein the leading edge (11) is stepped and an envelope curve (21) thereof is curved in the direction (23) of the trailing edge (12).

5. The blade (10) according to claim 4, wherein the trailing edge (12) is stepped and an envelope curve (22) thereof is curved.

6. The blade (10) according to claim 1, comprising a plurality of bars (19, 20) on the upper side of the blade.

7. The blade (10) according to claim 1, wherein the angle of the arch of the leading edge (11) or the envelope curve (21) thereof is equivalent to the angle of the arch of the trailing edge (12) or the envelope curve (22) thereof, and the wing-shaped profile is substantially the same over the entire length of the blade when viewed in cross-section.

8. The blade (10) according to claim 1, wherein the angle of the arch of the leading edge (11) or the envelope curve (21) thereof is not equivalent to the angle of the arch of the trailing edge (12) or the envelope curve (22) thereof.

9. The blade (10) according to claim 1, wherein the two opposite end edges (17, 18) are spaced from one another at the leading edge (11) at a leading edge spacing (a) and the two opposite end edges (17, 18) are spaced apart from one another at the trailing edge (12) at a trailing edge spacing (b), and the leading edge spacing (a) is greater than the trailing edge spacing (b).

10. The blade (10) according to claim 1, comprising at least two fastening holes (13) for securing the blade (10) to a rotor (1), wherein at least one of the fastening holes (13) takes the form of a slot, thereby allowing adjustability in a fastening position on the rotor (1).

11. A screen for treating a fibrous pulp suspension comprising:

a rotor (1) defining an axis (2) and having a plurality of blades (10) secured thereto, and a screen basket (8) circumscribing the rotor (1), wherein the blade (10) extends between a leading edge (11) and a trailing edge (12) with two opposite end edges (17, 18) therebetween and defines an upper side and lower side, the leading edge (11) or an envelope curve (21) thereof being arched in a direction toward the trailing edge (12), the trailing edge (12) or the envelope curve (22) thereof being arched in a common direction (23) relative to the leading edge (11), wherein the blade (10) has a cross-section with a wing-shaped profile having a convex upper surface.

12. The screen according to claim 11, wherein the blades (10) are secured to the rotor (1) such that a straight line (16) between points (14, 15) in the opposite end edges (17, 18) at the leading edge (11) is substantially parallel to the rotor axis (2).

13. The screen according to claim 11, wherein the blades (10) are secured to the rotor (1) on a slant such that a straight line (16) between the two endpoints (14, 15) of the leading edge (11) between points (14, 15) in the opposite end edges (17, 18) at the leading edge (11) is not parallel to the rotor axis (2).

14. The screen according to claim 11, wherein multiple blades (10) are mounted spaced apart from one another over the rotor height (Z) and a spacing (Y) between the respective blades and the screen basket (8) varies over the rotor height (Z).

15. The screen according to claim 13, wherein multiple blades (10) are mounted over the rotor height (Z) and have different slants from one another.

16. A blade (10) for screens used to treat a fibrous pulp suspension which blade (10) can be secured to a screen rotor (1), comprising:

a section extending from a leading edge (11) to a trailing edge (12) with two opposite end edges (17, 18) extending therebetween, the section between the leading edge (11) and trailing edge (12) defining an upper side and lower side, wherein the leading edge (11) or an envelope curve (21) thereof has a concave shape and the trailing edge (12) or an envelope curve (22) thereof has a concave shape, and the blade (10) has a wing-shaped cross section with a convex upper surface.

17. The blade (10) according to claim 16, wherein the curve of the concave leading edge (11) or the envelope curve (21) thereof is symmetrical across a center line (24).

18. The blade (10) according to claim 16, wherein the curve of the concave trailing edge (12) or the envelope curve (22) thereof is symmetrical across a center line (24).

19. The blade (10) according to claim 16, comprising two fastening holes (13) in the section between the leading edge (11) and trailing edge (12), wherein one hole lies on a center line (24) extending from the leading edge (11) to the trailing edge (12) and the other hole does not lie on the center line (24).

20. The blade (10) according to claim 16, comprising two fastening holes (13) in the section between the leading edge (11) and trailing edge (12), wherein one hole takes the form of a slot extending in the direction of two opposite end edges (17, 18) that connect the leading edge (11) and the trailing edge (12).

* * * * *